US005617639A

United States Patent [19]

Perry

[11] Patent Number: 5,617,639

[45] Date of Patent: Apr. 8, 1997

[54] RAILROAD MAINTENANCE VEHICLE REFERENCE SYSTEM TRANSDUCER

[75] Inventor: William E. Perry, Ludington, Mich.

[73] Assignee: Pandrol Jackson, Inc., Ludington, Mich.

[21] Appl. No.: 311,361

[22] Filed: Sep. 23, 1994

[51] Int. Cl.[6] ..... G01B 5/20

[52] U.S. Cl. ..... 33/1 Q; 73/146

[58] Field of Search ..... 33/1 Q, 1 PT, 33/287, 533, 645, 651, 651.1, 783, 706; 73/146

[56] References Cited

U.S. PATENT DOCUMENTS

| | | | |
|---|---|---|---|
| 853,126 | 5/1907 | Shires | 33/651.1 |
| 3,896,665 | 7/1975 | Goel | 73/146 |
| 3,906,789 | 9/1975 | Bingmann | 73/146 |
| 4,027,397 | 6/1977 | Theurer et al. | 33/1 Q |
| 4,654,973 | 4/1987 | Worthy | 33/1 Q |
| 4,691,565 | 9/1987 | Theurer | 33/287 |
| 5,161,312 | 11/1992 | Theurer et al. | 33/1 Q |

*Primary Examiner*—G. Bradley Bennett
*Attorney, Agent, or Firm*—Warner Norcross & Judd

[57] ABSTRACT

A transducer for use in a railroad track maintenance chord reference system for measuring the vertical and horizontal position of the rails of the track. The transducer is carried by a carriage riding on the rails and provides a signal indicative of the offset between the reference chord and the rails. Each transducer includes a uncounterbalanced arm mounted to the transducer housing by a low friction carriage. The arm engages and follows a reference chord causing the arm to move as the carriage moves with respect to the chord. A linear displacement transducer is mounted within the housing to provide a signal indicative of the arm position and therefore indicative of the position of the rails.

19 Claims, 4 Drawing Sheets

RAILROAD MAINTENANCE VEHICLE REFERENCE SYSTEM TRANSDUCER

BACKGROUND OF THE INVENTION

The present invention relates to a reference system for measuring the vertical and horizontal position of the rails of a railroad track, and more particularly to a transducer for use in such a system.

Chord reference systems are well known in the railroad industry. These reference systems are carried by a track maintenance vehicle to measure the vertical and horizontal disposition of the rails of a railroad track. For example, one such system includes a pair of horizontal height-measuring reference chords extending over each rail and a third horizontal lateral-measuring reference chord extending down the center of the vehicle. A carriage rides along the rails and carries a plurality of transducers-one or more for each chord. Each transducer includes an arm that rides on one of the reference chords to sense relative movement between the chord and the carriage.

As the maintenance vehicle moves along the track, the transducers measure the displacement of the reference chords with respect to the carriage riding on the track. The height-measuring transducers generate a signal indicative of the vertical undulations in the rail. The lateral-measuring transducers generate a signal indicative of the horizontal or lateral displacement of the rail. The transducer signals can be processed according to a variety of well known algorithms to acquire important information about the position and alignment of the rails and even to reconstruct a mathematical model (called a profile) of the track.

Typically the arm of each transducer is counterbalanced to offset its weight upon the-chord so that the chord can remain undeflected. This is particularly true for the height-measuring transducers. The need to counterbalance is commonly accepted wisdom in an attempt to acquire as accurate data as possible. However, counterbalancing has its drawbacks. First, counterbalancing structures are relatively delicate and not particularly well-suited to the rigors of railroad track maintenance. Second, a loss of tension or a break in the chord will not be readily detectable by the transducer because the arm will simply remain in place. Third, there is typically enough friction and inertia between the transducer arm and the transducer housing so that movement of the housing (e.g. in response to the rise and fall of the rails) imparts some movement to the arm, thereby introducing some inaccuracy in the measurements.

SUMMARY OF THE INVENTION

The aforementioned problems are overcome by the present invention wherein a chord reference system is provided having a non-counterbalanced arm mounted to the transducer housing by a low-friction mounting. The arm exerts a constant weight on the chord, and therefore creates a constant displacement offset of the chord, regardless of the position of the arm. Relative movement of the transducer arm still provides an accurate indication of real displacement due to relative movement of the chord and transducer carriage riding on the rail.

In the preferred embodiment, the housing contains a linear transducer having an actuating ring mounted to the arm so that movement of the arm is sensed by the linear displacement transducer.

The present invention provides a simple and effective means for measuring the relative displacement of a reference system chord and the vehicle frame. Because the arm is mounted to the transducer by a low friction carriage, the arm is not affected by the movement of the support frame. In addition, because the arms of the vertical transducers rest upon the vertical reference chords, a loss of tension or break in either vertical reference chord will be apparent from the fall of the arm, creating the maximum negative reading of the vertical transducers.

These and other objects, advantages, and features of the present invention will be more fully understood and appreciated by reference to the detailed description of the preferred embodiment and the drawings.

DETAILED DESCRIPTION OF THE PREFERRED EMBODIMENT

Figure 1:
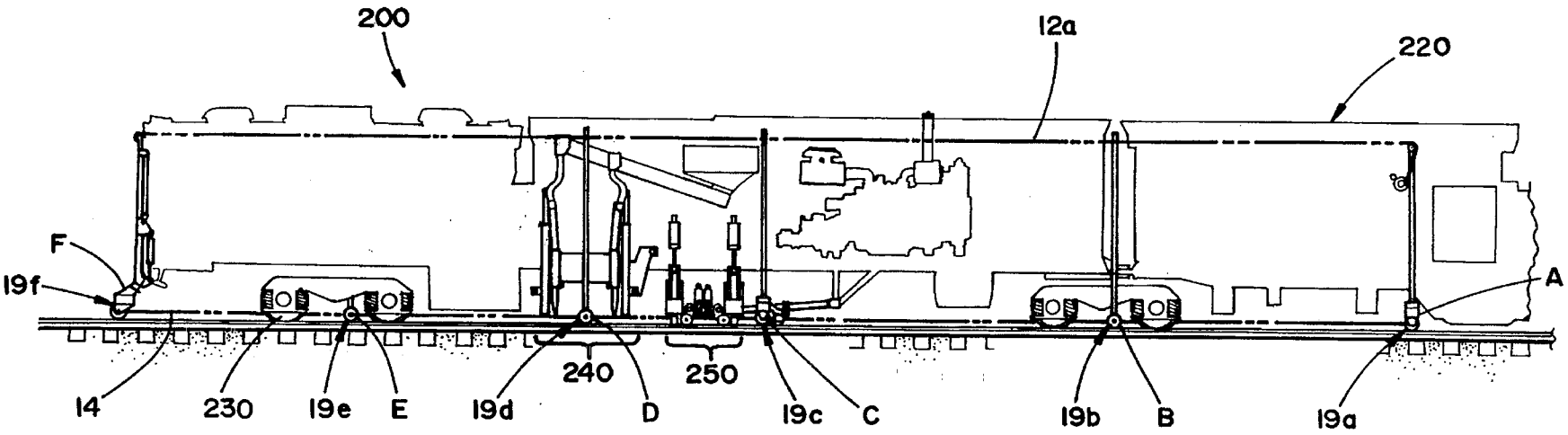
FIG. 1 is a side elevational view of a track vehicle supporting a reference system incorporating the transducer of the present invention.
Figure 3:
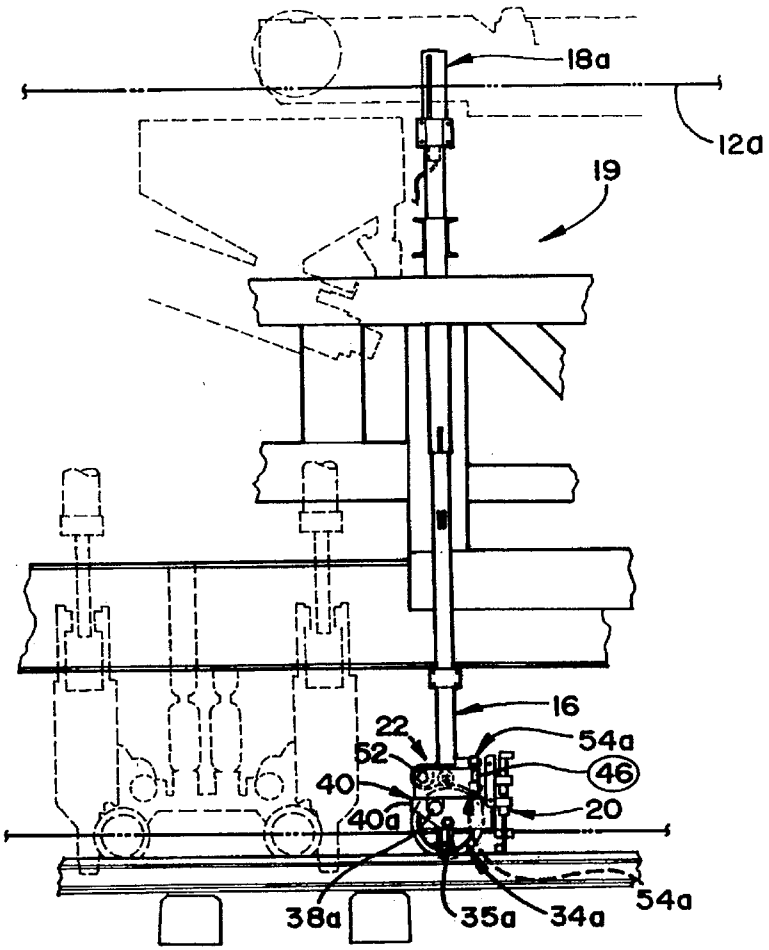
FIG. 3 is a side elevational view of the trolley.
Figure 2:
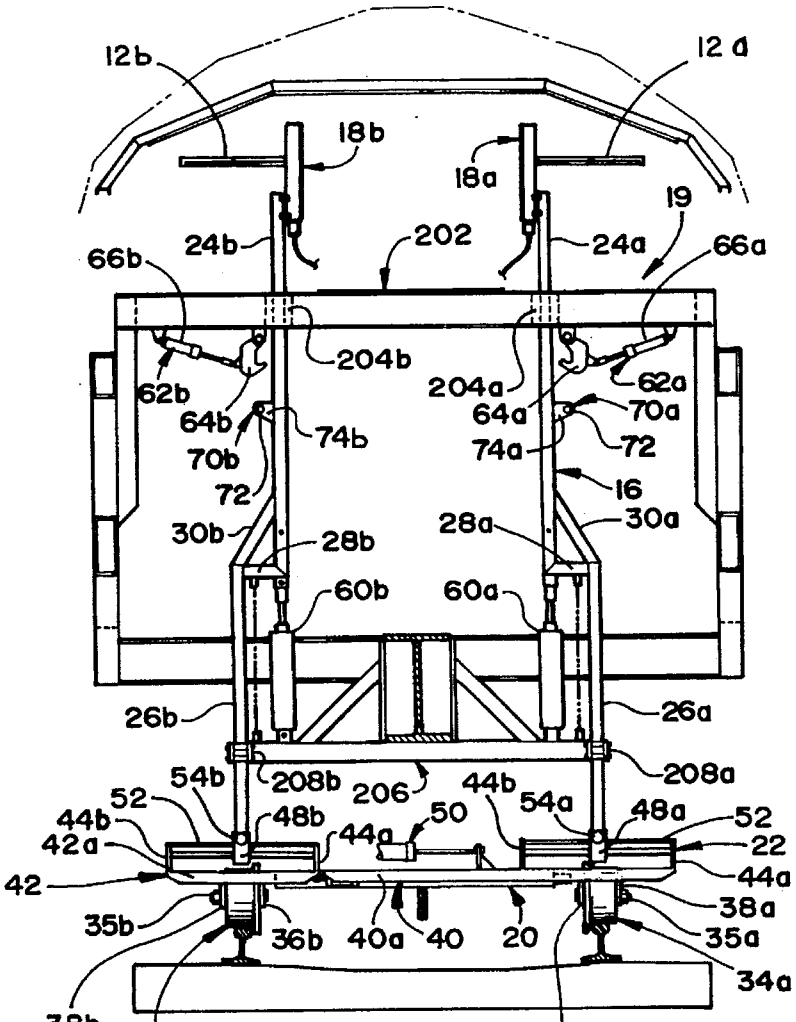
FIG. 2 is a front view of a reference system trolley.

By way of example and not by way of limitation, the transducers 18 of the present invention are shown in FIGS. 1–3 in conjunction with a reference system 10 for measuring the vertical and horizontal position of the rails of a railroad track. The height-measuring and lateral-measuring transducers 18*a–b* and 20 are carried by a track maintenance vehicle 200 on a number of support carriages 19*b–e*. Each of the transducers 18*a–b* and 20 includes an arm 106 and 122 that rides on one of a number of reference chords 12*a–b* and 14 to measure the displacement of the support carriage with respect to the respective chord. The measurements are used by the maintenance vehicle in computing the mathematical model or profile of the track.

The reference system 10 is carried on a track maintenance vehicle 200. In the preferred embodiment, the track maintenance vehicle 200 is a stoneblower that includes a superstructure 220, wheels 230, a plurality of workheads 240, and a jackbeam 250. A stoneblower is a track maintenance vehicle that is used to raise portions of a track that have fallen from level. Typically, the stoneblower travels along the rails until it reaches a portion of the track that requires maintenance. The jackbeam 250 then lifts the rails so that the workheads 240 can blow additional ballast stone beneath the sleepers or ties. The added stone is metered to support the lowered rails at the proper height. However, it should be readily apparent that the present invention is equally well suited for use with other track maintenance equipment, for example, tampers and curve liners.

The reference system 10 includes a pair of horizontal height-measuring reference chords 12*a* and 12*b* (See FIG. 2), a single horizontal lateral-measuring reference chord 14, a number of transducer support carriages 19*b–e*, and a number of vertical and horizontal transducers 18 and 20 carried upon the support carriages. The reference chords are stretched between opposite longitudinal ends of the track vehicle 200 from rail follower 19*a* to rail follower 19*f*. As perhaps best illustrated in FIG. 2, the height-measuring reference chords 12*a* and 12*b* extend along the upper extent of the track vehicle along opposite lateral sides, while the lateral-measuring reference chord 14 extends along the bottom, center of the vehicle 200.

Each of the transducer support carriages 19 is mounted to one of a number of trolleys 22 located at spaced locations B–E along the vehicle's 200 longitudinal extent. The support carriages 19 ride directly upon the trolleys 22 and consequently move up and down in correspondence with the rise and fall of the rails. In a preferred embodiment, the reference system 10 includes four transducer support carriages 19*b–e* mounted to trolleys located at positions B, C, D, and E. Trolleys C and D are located at least three meters from a loaded axle, thereby providing measurement of relatively unloaded rails. Trolleys B and E are located within one meter of a loaded axle, thereby providing a measurement of relatively loaded rails.

The preferred construction of a transducer support carriage 19 is illustrated in FIGS. 2 and 3. The described support carriage 19 carries or supports one horizontal and two vertical transducers 20 and 18*a–b*. However, the support carriage is easily adapted to carry any desired configuration of transducers. For example, in the preferred embodiment, a support carriage 19 having both vertical and horizontal transducers is located at positions C and D; a support carriage having only vertical transducers is located at position B; and a support carriage having only a horizontal transducer is located at position E.

The transducer support carriage 19 generally includes a support frame 16, a pair of vertical transducers 18*a* and 18*b*, and a horizontal transducer 20—all of which are carried upon the track rails by trolley 22. The support frame generally includes a pair of upper vertical posts 24*a–b* adjoined to a pair of lower vertical posts 26*a–b* by a pair of horizontal members 28*a–b* and a pair of braces 30*a–b*. It should also be apparent that the support frame 16 may vary in shape to fit within the profile of a given track vehicle 200.

The upper vertical posts 24*a* and 24*b* are mounted for vertical movement to the upper frame member 202 of the track vehicle by conventional bearing assemblies 204*a* and 204*b*. In addition, the lower vertical posts 26*a* and 26*b* are mounted for vertical movement to the lower frame member 206 of the track vehicle by conventional bearing assemblies 208*a* and 208*b*. As a result, the support carriage 19 is capable of vertical movement with respect to the track vehicle 200.

A catch 70*a* and 70*b* is mounted to each upper vertical post 24*a* and 24*b* to allow the support carriage to be secured in a raised position as described below. Each catch 70*a* and 70*b* is secured to a central portion of an upper vertical post 24*a* and 24*b*, respectively, and includes a rod 72 extending between a pair of parallel plates 74*a* and 74*b*.

A conventional bearing assembly 48*a–b* and a conventional sliding bushing assembly 54*a–b* are mounted to the lower extreme of each lower vertical post 26*a–b* to provide for slidable attachment to the trolley 22 as described below.

The trolley 22 generally includes a pair of conventional flanged rail wheels 34*a* and 34*b* mounted on axles 35*a* and 35*b*, respectively, for rolling movement on each of the rails. Inner and outer plates 36*a–b* and 38*a–b* extend upward along the wheels from opposite ends of each axle 35*a* and 35*b*. A long horizontal plate 40 is supported by inner and outer plates 36*a* and 38*a*, and a short horizontal plate 42 is supported by inner and outer plates 36*b* and 38*b*. The two horizontal plates 40 and 42 are horizontally aligned with one another and include forward and rear flanges 40*a* and 42*a* that strengthen the plates. A pair of guide supports 44*a* and 44*b* extend upward from each plate 40 and 42. A guide tube 46 and a guide rod 52 extends between each pair of guide supports. The guide tubes 46 and guide rods 52 extend through bearing assemblies 48*a–b* and bushings 54*a–b*, respectively, to secure the trolley 22 to the support frame 16 while allowing the two elements to shift horizontally with respect to one another.

Preferably, the trolley 22 includes an air cylinder 50 that allows the wheel span to be adjusted as necessary to align the wheels 24*a* and 24*b* with the rails. The first end of the air cylinder 50*a* is affixed to horizontal plate 40 and the second end of the cylinder 50*b* is affixed to horizontal plate 42. As the air cylinder 50 is extended and retracted, the two plates 40 and 42, and consequently the two wheels 24*a* and 24*b*, are driven apart or drawn together.

As referred to above, the present invention includes a system for lifting the transducer support carriages 19 from the rails. This is particularly useful when the track vehicle 200 is in the travelling mode. The lifting system generally includes a pair of air cylinders 60*a* and 60*b* extending between the lower frame member 206 and the horizontal members 28*a* and 28*b*. These air cylinders 60*a* and 60*b* raise and lower the transducer support carriage 19. The lifting system further includes a pair of air actuated hook assemblies 62*a* and 62*b* that latch onto catches 70*a* and 70*b* to secure the transducer support carriage 19 in the raised position. The air actuated hook assemblies 62*a* and 62*b* each include a hook 64*a* and 64*b* pivotally mounted to upper frame member 202 and an air cylinder 66*a* and 66*b* pivotally extending between the hook 64 and the upper frame member 202.

Figure 6:
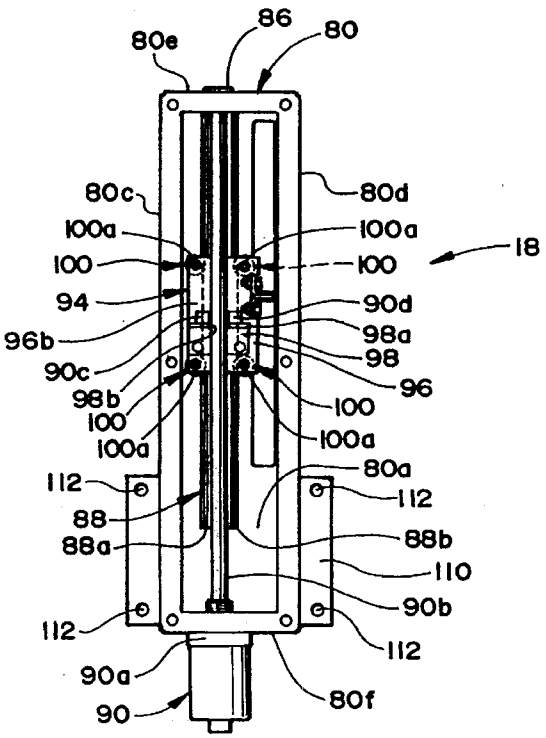
FIG. 6 is a rear elevational view of the vertical transducer.
Figure 4:
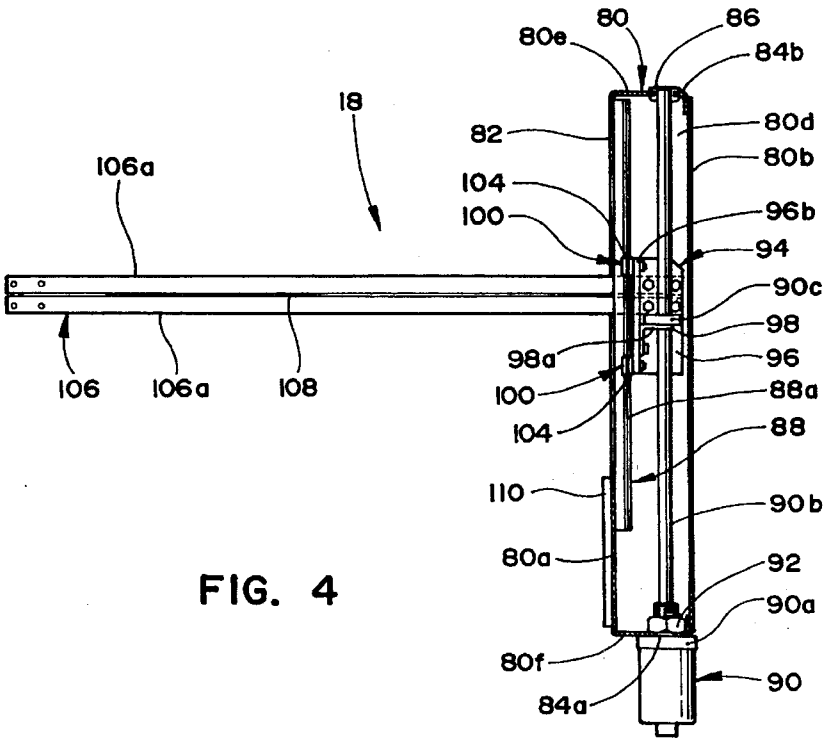
FIG. 4 is a side elevational view of the vertical transducer of the present invention with portions cut away.
Figure 5:
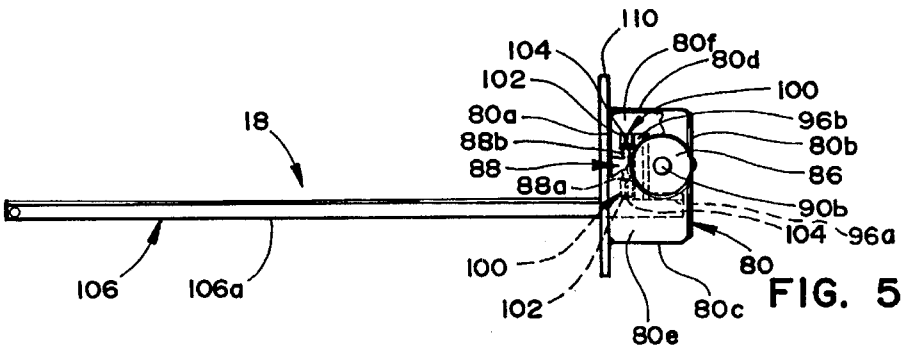
FIG. 5 is a top plan view of the vertical transducer with portions cut away.

The vertical transducers 18*a* and 18*b* are mounted to an upper portion of the upper vertical posts 24*a* and 24*b* as shown in FIGS. 2 and 3. Referring now to FIGS. 4–6, each vertical transducer 18 generally includes a vertically elongated rectangular housing 80 having a front wall 80*a*, a back cover 80*b*, two sides wall 80*c* and 80*d*, a top wall 80*e*, and a bottom wall 80*f*. The back cover 80*b* is removably secured to the remainder of the housing 80 by conventional fastening means, such as screws, to provide selective access to the interior thereof. A vertical slot 82 is defined in the front wall 80*a* of the housing 80, and a pair of circular openings 84*a* and 84*b* are formed in the top and bottom walls of the housing 80*e* and 80*f*. A grommet 86 is fit within opening 84*b*. A slideway 88 is mounted to front wall 80*a* adjacent slot 82. The slideway 88 is generally T-shaped and is secured by conventional screws and locknuts extending through the front wall 80*a* of the housing 80. The two short legs of the slideway form a pair of runners 88*a* and 88*b* that are shaped to mate with carriage rollers 100, as described below.

The vertical transducers 18*a–b* also include a linear displacement transducer. A linear displacement transducer operates by generating an electrical signal in response to movement of an actuating ring along the transducer's shaft. Typically, the actuating ring is formed of a magnetic material that induces an electrical current within the shaft as it moves. The induced electrical current may be amplified or filtered as necessary to provide an electrical signal indicative of the movement of the actuating ring. In the present invention, linear displacement transducer 90 having a threaded base 90*a*, a shaft 90*b*, and an actuating ring 90*c* is fit within the housing 80. The shaft 90*b* is generally cylindrical and extends upward through opening 84*a* into opening 84*b*. Grommet 86 fits around the free end of the shaft 90*b* to hold it snugly within opening 84*b*. The actuating ring 90*c* of the transducer is a magnetic ring having a central opening 90*d* dimensioned to fit around the shaft 90*b*. The linear displacement transducer 90 is secured within the housing 80 by a jamnut 92 that threadedly engages the base 90*a* (see FIG. 4). The transducer 90 functions by generating analog signals in response to movement of the actuating ring 90*c* along the longitudinal extent of shaft 90*b* in the manner described above.

The vertical transducer 18 further includes a low friction carriage 94. The carriage 94 generally includes an L-shaped carriage plate 96, an L-shaped actuating ring mounting bracket 98, and four rollers 100. The mounting bracket 98 is mounted to a central portion of the front surface 96*a* of the carriage plate 96 by a pair of conventional nuts and bolts. The free leg 98*a* of the mounting bracket 98 extends perpendicularly from the carriage plate 96 and includes a notch 98*b* dimensioned to fit around the shaft 90*b* of the linear displacement transducer 90. The actuating ring 90*c* is affixed to the mounting bracket 98 by conventional screws such that central opening 90*d* aligns with notch 98*b* to provide a passage for shaft 90*b* (see FIG. 6). The four rollers 100 are concentrically mounted on bearings 100*a* secured to the rear surface 96*b* of the long leg of the carriage plate 96. The running surface 102 of each roller 100 is contoured to mate with the runners 88*a* and 88*b* of the slideway 88. Preferably, this contour includes a circumferential groove 104 extending around the running surface 102 of each roller 100 (see FIG. 5). The low friction carriage 94 is mounted for vertical movement along slideway 88 with grooves 104 engaging runners 88*a* and 88*b*.

The vertical transducer 18 includes an arm 106 that is affixed to the carriage 94 and extends from the housing through slot 82. The arm 106 includes two angles 106*a* and 106*b* spaced slightly apart from one another to define a slot 108. Preferably, a conventional screw, washer, and locknut are secured to the end of the arm 106 opposite the carriage 94 to provide a means for entrapping a reference chord within slot 108. The arm 106 is secured to surface 96*c* of the carriage plate 96 by conventional screws and locknuts so that vertical movement of the arm 106 results in vertical movement of the carriage 96 and actuating ring 90*c*.

The vertical transducer also includes a mounting plate 110 that is secured to a lower portion of the front surface 80*a* of the housing 80 by welding or conventional fasteners. The mounting plate 110 includes a series of throughbores 112 for use in securing the vertical transducer 18 to the support frame 16.

Figure 7:
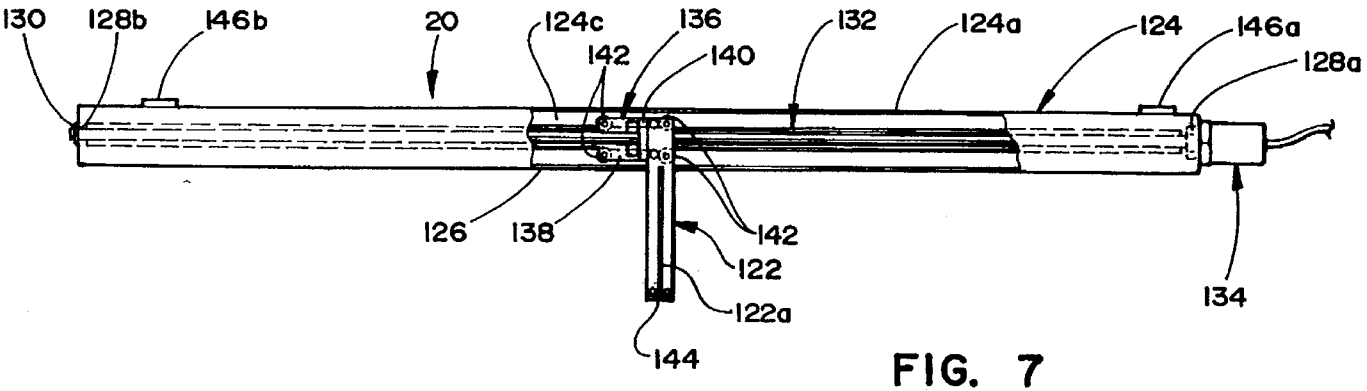
FIG. 7 is a front elevational view of the horizontal transducer of the present invention.
Figure 8:
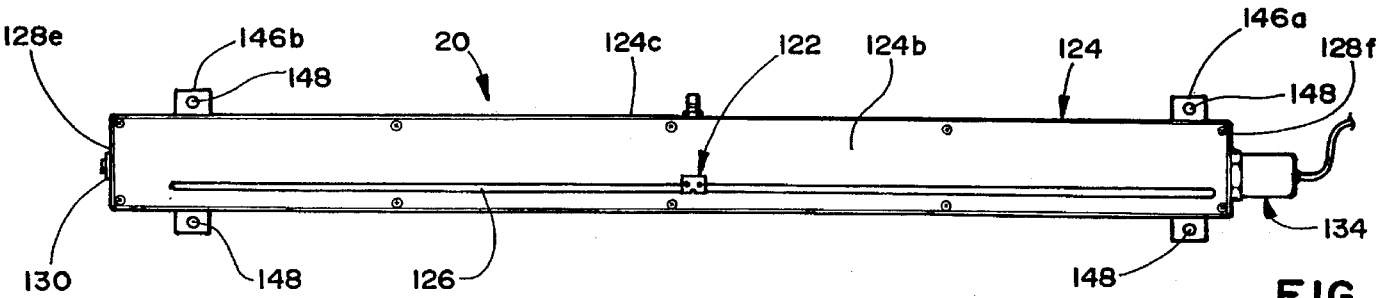
FIG. 8 is a bottom plan view of the horizontal transducer.
Figure 9:
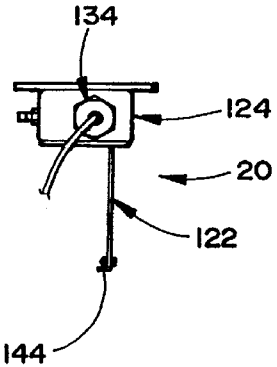
FIG. 9 is a side elevational view of the horizontal transducer.

As perhaps best illustrated in FIGS. 2 and 3, the horizontal transducer 20 is carried below the long horizontal plate 40 of the trolley. The horizontal transducer 20 is somewhat similar to the vertical transducer 18. However, there exists some distinctions that are described below. Referring now to FIGS. 7–9, the horizontal transducer 20 generally includes a horizontally elongated rectangular housing 124 that is generally identical to, but significantly longer than, the housing of the vertical transducer 18. The housing 124 includes a horizontal slot 126 that extends through a removable cover 124*b* and a pair of openings 128*a* and 128*b* that are defined in opposite end walls 128*e* and 128*f*. The horizontal transducer further includes a grommet 130 fit within opening 128*b*, a slideway 132 mounted to back wall 124*c*, a linear displacement transducer 134, a low friction carriage 136, an arm 122, and a pair of mounting plates 146*a* and 146*b*.

The low friction carriage 136 of the horizontal transducer 20 is generally identical to the low friction carriage 94 of the vertical transducer 18. However, the L-shaped carriage plate 96 is replaced by a flat, rectangular carriage plate 138. The mounting bracket 140 and rollers 142 are structurally equivalent to those described in connection with the vertical transducer 18, and are preferably mounted in a similar manner.

The arm 122 of the horizontal transducer 20 is somewhat different from the arm of the vertical transducer 18. Arm 122 is an elongated, rectangular plate that defines a vertical slot 122*a*. The arm 122 is secured to the carriage plate 138 by conventional fasteners and extends parallel to the carriage plate 138 through slot 126 in housing 124. The vertical slot 122*a* defined within the arm 122 receives the lateral-measuring reference chord 14. Preferably, a retaining bracket 144 is mounted by conventional screws and locknuts to the arm 122 adjacent the open end of slot 126. The retaining bracket 144 traps the reference chord within slot 126.

As noted above, the horizontal transducer further includes a pair of mounting plates 146*a* and 146*b*. The two mounting plates 146*a* and 146*b* are mounted to opposite longitudinal ends of the top surface 124*a* of the housing 124 by welding or conventional fasteners. The mounting plates 146*a* and 146*b* each includes a pair of throughbores 148 for use in securing the horizontal transducer 20 beneath the horizontal plates 40 and 42 of the trolley 22.

Preferably, the transducer housing, slideway, low friction carriage, and transducer arm are constructed of aluminum or other nonmagnetic materials. This provides for the most accurate reading of the movements of the actuating ring.

OPERATION

In operation, vertical and horizontal transducers are mounted to various transducer support carriages 19*b–e* as necessary to provide the desired measurements. In a preferred embodiment, support carriages 19*b*, 19*c*, and 19*d* include vertical transducers and support carriages 19*c*, 19*d*, and 19*e* include horizontal transducers. The height-measuring and lateral-measuring reference chords 12 and 14 are tightly stretched between opposite longitudinal end points of the track vehicle 200 and extend through the slots 108 and 126 defined in the appropriate vertical and horizontal transducer arms.

Unlike the prior art, the arms of the vertical transducers are not counterbalanced. Instead, their weight is carried by the reference chords. As the track vehicle 200 travels along the track, the rise and fall of the rails causes the transducer support carriages 19*b–d*, which ride upon the trolleys, to move vertically with respect to the height-measuring reference chords. This vertical movement is transferred to each vertical transducer thereby causing the low friction carriage to travel along the slideway and move the actuating ring along the shaft of the linear displacement transducer. The movement of the actuating ring along the shaft of the linear displacement transducer generates an analog signal indicative of the magnitude of the movement. It should be apparent that vertical movement does not affect the horizontal transducer because the lateral-measuring reference chord moves freely within vertical slot 122*a*.

In a similar fashion, and particularly when the track vehicle 200 is on a spiral or curve portion of track, the lateral-measuring reference chord 14 is laterally displaced from the transducer carriage. The relative movement of the chord causes the arm, low friction carriage, and actuating ring of each horizontal transducer to move horizontally along the slideway. This movement in turn causes the actuating ring to move horizontally along the shaft of the linear displacement transducer, thereby generating an analog signal indicative of the magnitude of the horizontal movement of the rails. Again, it should be apparent that horizontal movement does not affect the vertical transducers because the height-measuring reference chords moves freely within horizontal slot 108.

The data received from the transducers can be processed according to well known techniques to provide a reconstruction of the track profile reflecting both the vertical and horizontal disposition of the rails. The data can be processed in real time to provide profile of the rails during maintenance. Alternatively, the data can be stored until the measuring run is complete and a post-measurement profile can be generated. A variety of algorithms for reconstructing the track profile based on the collected data are known to those of ordinary skill in the field.

The present invention may also be used to measure the void beneath an unloaded track. As noted above, trolleys B and E provides measurements of a loaded track while trolleys C and D provide measurements of an unloaded track. Consequently, the loaded and unloaded track measurements can be processed to provide a measurement of the void beneath an unloaded track.

In addition, the present invention may be used to ensure that the rail is lifted to the proper height during maintenance. For example, during maintenance the track is lifted by jack beam 250 so that the workheads 240, located at trolley D, can operate. Because of their location, the vertical transducers located at trolley D provide an accurate measure of the height of the rail adjacent the workheads 240.

Further, the present invention provides a means for checking the profile of the rails to ensure the maintenance has been properly performed. As noted above, maintenance is performed at trolley D. Consequently, rail follower F rides upon a portion of the track where maintenance has already been performed while rail follower A rides upon an portion where maintenance has not been performed. Using a simple three-point algorithm, a measurement taken at trolley B provides the data necessary to ensure that the maintenance procedure lifted the rail to the proper height.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A transducer assembly for use in measuring the position of the rails of a railroad track with respect to a reference chord located above the track, said assembly comprising:

a housing;

a linear displacement transducer mounted within said housing and including a movable actuating member, said transducer producing a signal indicative of the position of said actuating member;

a slideway mounted adjacent said linear displacement transducer within said housing;

a carriage movably mounted to said slideway and carrying said transducer actuating member; and an arm affixed to said carriage and extending from said housing whereby movement of said arm results in movement of said carriage along said slideway and of said actuating member.

2. The transducer assembly of claim 1 wherein said arm defines a slot for receiving the reference chord.

3. The transducer assembly of claim 2 herein said arm further includes a retaining means for entrapping said reference chord within said slot.

4. The transducer assembly of claim 1, wherein said carriage includes a plurality of rollers, each of said rollers having a nonlinear, contoured running surface; and wherein said slideway includes runners contoured to mate with said running surface of said rollers.

5. A transducer assembly for a railroad track maintenance vehicle, said transducer assembly being of the type following a reference chord and providing a signal indicative of the relationship of a rail to the reference chord, said assembly comprising:

a housing;

linear transducer means mounted to said housing and including a movable member, said transducer means being for providing a signal indicative of the position of said movable member; and an uncounterbalanced arm having first and second portions, said first arm portion attached to said member, said second arm portion defining a void for receiving the reference chord, whereby said arm follows the reference chord to move said movable member.

6. A transducer carriage assembly for use in measuring the disposition of the rails of a railroad track by following a structural reference chord extending longitudinally with respect to the track, said carriage assembly comprising:

a support carriage adapted to travel upon the rails of a railroad track; and a transducer assembly mounted to said support carriage, said transducer assembly including:

a housing;

a low friction carriage movably mounted to said housing;

a non-counterbalanced arm affixed to said low friction carriage and extending from said housing whereby movement of said arm results in movement of said low friction carriage; and measuring means for generating a signal indicative of the movement of said low friction carriage.

7. The transducer carriage assembly of claim 6, wherein said measuring means includes a linear displacement transducer mounted within said housing; and an actuating means for actuating said linear displacement transducer, said actuating means mounted to said low friction carriage for movement along said linear displacement transducer.

8. The transducer carriage assembly of claim 7, further comprising a slideway mounted within said housing adjacent said linear displacement transducer, said low friction carriage movably mounted to said slideway.

9. The transducer carriage assembly of claim 8, wherein said low friction carriage includes a plurality of rollers, each of said rollers having a nonlinear, contoured running surface; and wherein said slideway includes runners contoured to mate with said running surface of said rollers.

10. The transducer carriage assembly of claim 9, wherein said linear displacement transducer includes a longitudinally extended shaft;

wherein said actuating means includes a magnetic ring dimensioned to fit around said shaft.

11. The transducer carriage assembly of claim 10, further comprising a lifting means for raising and lowering said support frame with respect to a track vehicle.

12. The transducer carriage assembly of claim 11 further comprising a trolley said trolley and said support frame being secured to one another by a coupling means for allowing said trolley and said support frame to shift horizontally with respect to one another.

13. The transducer support carriage assembly of claim 12, wherein said coupling means includes a horizontally disposed guide rod affixed to one of said trolley and said support frame and a bearing assembly affixed to the other of said trolley and said support frame, said guide rod extending through said bearing assembly.

14. An improved reference system for measuring the position of the rails of a railroad track, said system including a reference chord, a support carriage for riding on and following the railroad track, a transducer assembly carried by the support carriage and engaging and following the reference chord to provide a signal indicative of the relative position of the support carriage and the chord, wherein the improvement comprises said transducer assembly comprising:

a housing;

a low friction carriage movably mounted to said housing;

a non-counterbalanced arm affixed to said low friction carriage and extending from said housing to engage and to follow said chord, whereby movement of said arm while following said chord results in movement of said low friction carriage; and signal means for generating a signal indicative of the position of said low friction carriage with respect to said housing.

15. The reference system of claim 14, wherein said measuring means includes a linear displacement transducer mounted within said housing; and an actuating means for actuating said linear displacement transducer, said actuating means mounted to said low friction carriage for movement along said linear displacement transducer.

16. The reference system of claim 15, further comprising a slideway mounted within said housing adjacent said linear displacement transducer, said low friction carriage movably mounted to said slideway.

17. The reference system of claim 16, wherein said low friction carriage includes a plurality of rollers, each of said rollers having a nonlinear, contoured running surface; and wherein said slideway includes runners contoured to mate with said running surface of said rollers.

18. The reference system of claim 17, wherein a slot is defined in said arm for receiving said reference chord.

19. The reference system of claim 17, wherein said arm is comprised of a pair of spaced apart angle members defining a slot for trapping said reference chord therebetween.

* * * * *